US005632419A

United States Patent [19]

Pickens

[11] Patent Number: 5,632,419

[45] Date of Patent: May 27, 1997

[54] SNOWFALL SIMULATOR WITH AGITATING DISPENSER

[75] Inventor: Timothy J. Pickens, Lutz, Fla.

[73] Assignee: Snowmaker Productions, Inc., Lutz, Fla.

[21] Appl. No.: 394,178

[22] Filed: Feb. 24, 1995

[51] Int. Cl.[6] ..... B67D 3/00

[52] U.S. Cl. ..... 222/189.05; 222/485; 40/410; 472/65

[58] Field of Search ..... 40/410; 472/65; 222/189.05, 200, 333, 409, 485, 565; 209/315, 341, 342; 239/689, DIG. 23

[56] References Cited

U.S. PATENT DOCUMENTS

| | | | |
|---|---|---|---|
| 241,924 | 5/1881 | Buswell | 222/200 |
| 335,709 | 2/1886 | Lovin | 222/189.05 X |
| 1,101,422 | 6/1914 | Fielding | 40/410 |
| 2,543,606 | 2/1951 | Solomon | 40/410 |
| 2,587,620 | 3/1952 | Hormann | 472/65 X |
| 2,897,619 | 8/1959 | Zenz | 40/106 |
| 3,243,183 | 3/1966 | De Scrange | 472/65 |
| 3,494,614 | 2/1970 | Taylor | 272/8 |
| 3,999,750 | 12/1976 | Perkins | 272/15 |
| 4,028,830 | 6/1977 | Ottinger | 40/106 |
| 4,076,234 | 2/1978 | Burnbaum | 272/15 |
| 5,098,084 | 3/1992 | Culver | 272/15 |
| 5,200,239 | 4/1993 | Chen | 428/13 |

FOREIGN PATENT DOCUMENTS

| | | | |
|---|---|---|---|
| 610758 | 6/1978 | U.S.S.R. | 222/200 |

*Primary Examiner*—Andres Kashnikow
*Assistant Examiner*—Kenneth Bomberg

[57] ABSTRACT

A snowfall simulator which houses and dispenses artificial snow from a box like housing (20) using agitation. The box or dispenser has small openings (32) uniformly placed on the bottom horizontal plane. Mounted directly over the desired area, shaved polystyrene, used for snow, is placed inside the housing. A small motor (14) attached on the outside of the housing is connected by gear (16) and shaft (18) to a light-weight reticulated agitation plate (24) resting on the inside bottom horizontal plane of housing. The motor creates a gentle horizontal agitation under the artificial snow causing it to slowly work itself out of the dispenser through the bottom openings. By this arrangement, a long-lasting, gentle, realistic snowfall effect is created uniformly over an imitation village, Christmas tree, or display. Once the dispenser is empty, the snow can be collected off the bottom and placed back into the dispenser for further enjoyment.

14 Claims, 1 Drawing Sheet

SNOWFALL SIMULATOR WITH AGITATING DISPENSER

BACKGROUND—FIELD OF INVENTION

This invention relates to decorative seasonal merchandise, specifically to a way of creating the effect of gentle falling snow over a small imitation village, Christmas tree or display.

BACKGROUND—DESCRIPTION OF PRIOR ART

The desire to produce the soothing, wintry effect of gentle falling snow as part of the decorating scheme for small store-bought or home-made villages and towns, or Christmas trees, has been around for a while. Some have thought the only way this is possible is to make an enclosure and blow the snow around with a fan as seen in U.S. Pat. No. 1,101,422, Fielding, Jul. 18, 1913. Others use devices that eject large quantities of artificial snow out from a central location downward into a large catch basin and with a suction or drive device recirculates the snow hack to the exit hole as seen in U.S. Pat. No. 4,028,830 to Ottinger, Jun. 14, 1977 and U.S. Pat. No. 5,098,084 to Culver, Mar. 24, 1992. In U.S. Pat. No. 3,999,750 to Perkins, December 1975, a pressurized holding tank ejects artificial snow from nozzles above a display. Such devices hinder the desire for realistic, gentle falling snow while at the same time being visually obstrusive. Furthermore, most inventors thought that the snow had to be collected immediately and automatically off the ground in order to make it practical and to produce the effect for an indefinite period of time. Therefore, they failed to consider that both practicality and length of effect can be attained by other means.

OBJECTS AND ADVANTAGES

It is therefore an object of this invention to create a gentle, uniform artificial snowfall for mainly in-home use which:

(a) collects naturally on the display's terrain, and (b) falls from a broad area over the display, and (c) falls in a visually pleasing way, and (d) lasts for several hours.

Another object of this invention is utilizing artificial snow that resembles real snow: flattened and flake-like, uneven in size, and has a very slow rate of fall.

Further objects and advantages will become apparent from a consideration of the drawings and ensuing description.

DRAWING FIGURES

REFERENCE NUMERALS IN DRAWINGS

| |
|---|
| 12 battery pack |
| 14 motor |
| 16 planetary gear and ball joint |
| 18 shaft |
| 20 base housing |
| 24 agitation plate |

-continued

| |
|---|
| 26 ceiling mount holes |
| 28 bracket sleeves |
| 32 exit holes |
| 36 shaft hole |
| 38 plastic riser |

DESCRIPTION—FIGS. 1 & 2

Figure 1:
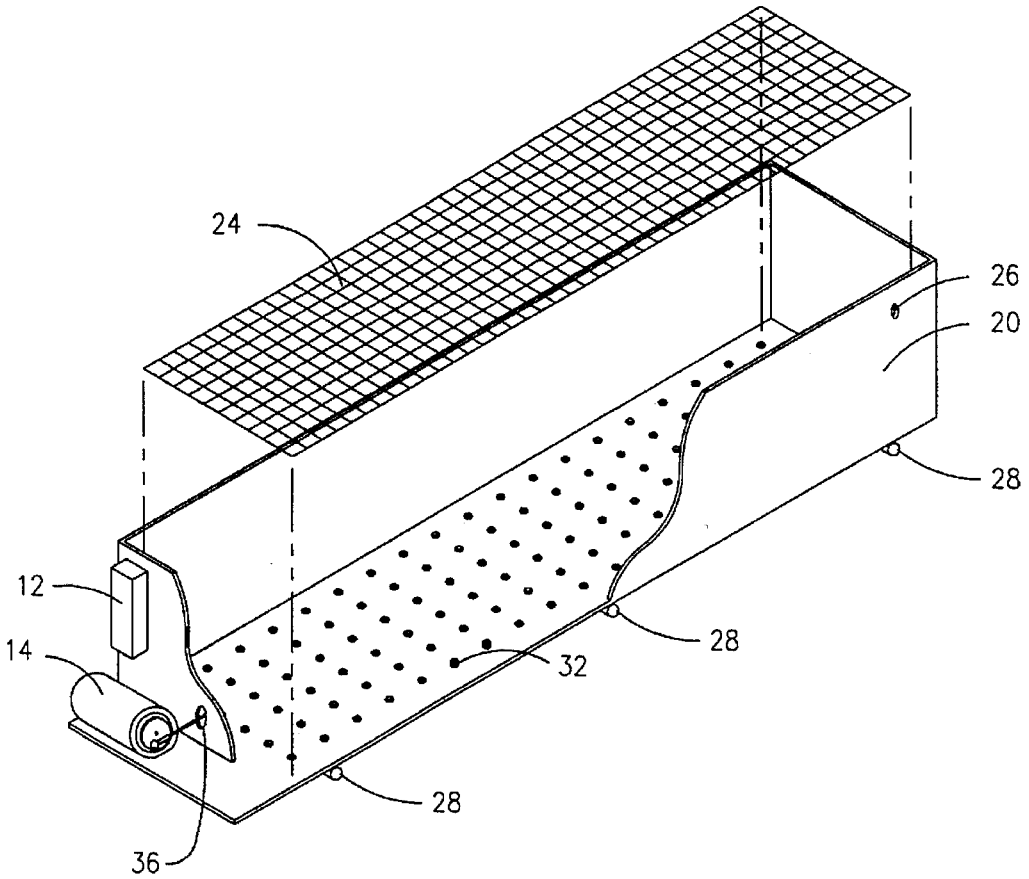
FIG. 1 shows a perspective view with plate 24 exploded above and the sides of the front corner cut away.

FIG. 1 shows a basic version of this invention. The base dispensing unit, box, or housing 20 consists of uniformly spaced openings or exit holes 32 on its bottom horizontal plane. Base 20 is made preferably of lightweight plastic one sixteenth to one eighth inch in thickness on all sides. The front and back sides have small holes at the upper comers for optional suspended ceiling mount using single strand wire or monofiliment line (not shown). Sleeves 28 attached on the underside of base 20 allow for stable mounting with a conventional rod-type wall bracket (not shown). A reticulated agitation plate or rigid mesh 24 is made approximately one half to one inch shorter than the inside length of base 20 and one sixteenth to one quarter inch narrower than the width. Plate 24 is slightly elevated off the bottom of base unit 20 with hollow, straw-like plastic risers 38 positioned at intervals along the edge sufficient to maintain support. A motor 14 powered by a battery pack 12 is mounted at one end of base unit 20. A planetary gear and ball 16 is attached to the shaft of motor 14. A shaft or crank am 18 is attached to planetary gear and ball 16 by coupling and, inserted through hole 36, is connected to plate 24 by nut and bolt or other suitable connection.

The preferred type of snow for this invention is shaved polystyrene. Any mass of fine particles which when falling has characteristics of snow can be used in this invention, but it is not preferred. For example, Polystyrene that is simply pulverized into minute pellets would agitate out of housing 20 and fall on the display but it still lacks other snow-like qualities thereby lessening the impact on the mind's eye. However, polystyrene which is shaved from a polystyrene block using a carpenter's block plane type shaver or auto-body shaver, for instance, produces flattened flakes of various proportions which are less aerodynamic than pellets producing a realistic locking snow and a slower, wave-like, natural rate of fall.

OPERATION—FIGS. 1 & 2

Figure 2A:
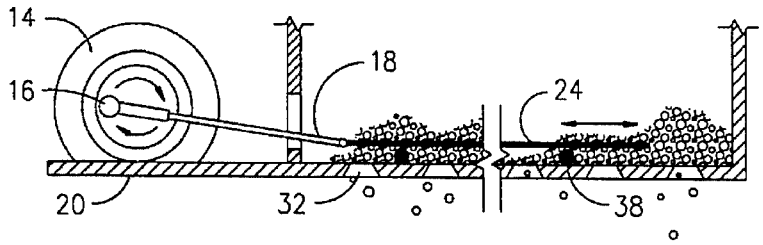
FIG. 2A and FIG. 2B shows two side views illustrating the linear motion of plate 24.
Figure 2B:
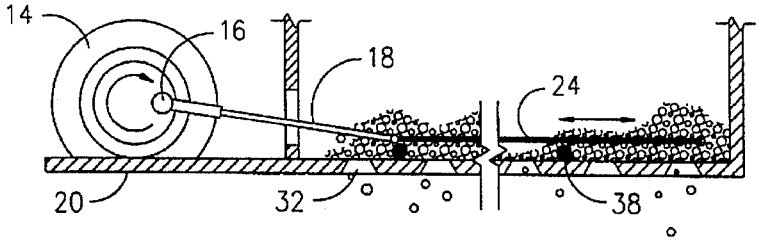

The goal driving this invention is, as stated: to produce a natural, slow, uniform covering of realistic snowfall. This can be achieved best by suspending the snow from above the display, as real snow is in clouds and, with the help of gravity, agitate the collection of snow over openings small enough that without agitation would not fall freely. This is what my invention accomplishes. The base unit 20 provides the housing and openings 32 for the snow. Referring now to FIG. 2, plate 24 is moved horizontally back and forth by converting the rotational energy or motion of motor 14 into linear motion by properly connecting planetary gear and ball 16, by coupling and shaft to plate 24. Plate 24makes one revolution, from position "A" to position "B" and back to "A," in approximately 2 to 4 seconds, faster if more snowfall is desired. The slight elevation of plate 24 with risers 38 accomplishes two things: it creates less friction on the surface of base 20 putting less strain on motor 14 and, secondly, works to trap the snow between plate 24 and the bottom of base 20 forcing the snow out the exit holes 32. Static electricity in the polystyrene shavings, while visibly present, can be more of a help than a hindrance. While the static effect does cause the snow to cling to the surface or passageways, it does not permanently obstruct the openings during operation. If a hole is clogged with snow particles the continued agitation will eventually clear the obstruction, causing a random slow dispersment of the snow. However, to increase the flow of snowfall, and to make it easier to handle, a small amount of talc power can be applied to the snow prior to use.

CONCLUSION, RAMIFICATIONS, AND SCOPE OF INVENTION

Thus the reader will see that the snowfall simulator provides a decorative, lightweight, easy to use device which produces a visually stimulating addition to any display. While my above description and operation contains many specificities, these should not be construed as limitations on the scope of the invention, but rather as an exemplification of one preferred embodiment thereof. Many other variations are possible. For example, there may be several ways to create horizontal motion of agitation plate 24. One might use a camber and camber follower or a reversing motor with the proper linkage. One might also use a flexible shaft connected to plate 24 which would create a more circular, yet horizontal motion. Motor 14 can be mounted on the back side rather than on the end and have variable speeds. Furthermore, lights can be mounted on the underside to provide light to the display below and to illuminate the snow. Base 24 can be made adjustable to cover larger areas by having attachable sides and bottoms. Base 24 can also be made to resemble a cloud with the use of a decorative facade. Another optional feature in the design of the snow simulator would be a low rpm fan mounted underneath base unit 24 to gently blow the falling snow over a broader area.

Thus the scope of the invention should be determined by the appended claims and their legal equivalents, rather than by the examples given.

I claim:

1. A dispensing apparatus for artificial snow, comprising:

a housing having at least one sidewall and a horizontal base having plurality of exit holes;

an agitation plate mounted for horizontal movement within the housing elevated above the horizontal base;

at least one riser between the horizontal base and the agitation plate for spacing the horizontal base from the agitation plate; and a means for horizontally reciprocating the agitation plate above the horizontal base to dispense said artificial snow from said plurality of exit holes.

2. The dispensing apparatus according to claim 1 wherein said housing includes sleeves for mounting said dispensing apparatus to a wall bracket.

3. The dispensing apparatus according to claim 1 wherein said housing is rectangular.

4. The dispensing apparatus according to claim 3 wherein said agitation plate is rectangular.

5. The dispensing apparatus according to claim 1 wherein said agitation plate is a rigid mesh with a width which is shorter than a width of said housing.

6. The dispensing apparatus according to claim 1 wherein there are a plurality of said at least one risers, and said plurality of risers are made of plastic and are straw shaped.

7. The dispensing apparatus according to claim 1 wherein said means for horizontally reciprocation the agitation plate comprises a motor with a motor shaft, a planetary gear and ball attached to said motor shaft, and a crank arm attached at one end to the planetary gear and ball and attached at another end to the agitation plate.

8. The dispensing apparatus according to claim 7 wherein said motor is powered by a battery pack.

9. A dispensing apparatus for artificial snow, comprising:

a housing having at least one sidewall and a horizontal base having plurality of exit holes;

an agitation plate mounted for horizontal movement within the housing above the horizontal base, said agitation plate made of a rigid mesh of a shorter length and a shorter width than the base;

a multiplicity of artificial snow particles contained within said housing, said artificial snow particles having individual sizes smaller than said exit holes, said artificial snow particles being made of shaved polystyrene;

a means for horizontally reciprocating the agitation plate above the horizontal base to dispense said artificial snow particles from said plurality of exit holes.

10. The dispensing apparatus according to claim 9 wherein said housing includes sleeves for mounting said dispensing apparatus to a wall bracket.

11. The dispensing apparatus according to claim 9 wherein said housing is rectangular.

12. The dispensing apparatus according to claim 11 wherein said agitation plate is rectangular.

13. The dispensing apparatus according to claim 9 wherein said means for horizontally reciprocation the agitation plate comprises a motor with a motor shaft, a planetary gear and ball attached to said motor shaft, and a crank arm attached at one end to the planetary gear and ball and attached at another end to the agitation plate.

14. The dispensing apparatus according to claim 13 wherein said motor is powered by a battery pack.

* * * * *